US007686655B2

(12) United States Patent
Tsai

(10) Patent No.: US 7,686,655 B2
(45) Date of Patent: Mar. 30, 2010

(54) MINI PLUG CONNECTOR

(75) Inventor: Wen-Hsien Tsai, Taipei Hsien (TW)

(73) Assignee: Advanced Connectek Inc., Taipei Hsien (TW)

( * ) Notice: Subject to any disclaimer, the term of this patent is extended or adjusted under 35 U.S.C. 154(b) by 15 days.

(21) Appl. No.: 12/210,362

(22) Filed: Sep. 15, 2008

(65) Prior Publication Data

US 2009/0124133 A1 May 14, 2009

(30) Foreign Application Priority Data

Nov. 9, 2007 (TW) ..... 96218973 U

(51) Int. Cl.
*H01R 24/00* (2006.01)

(52) U.S. Cl. ..... 439/660; 439/607.05

(58) Field of Classification Search ..... 439/660, 439/79, 607.05, 607.08
See application file for complete search history.

(56) References Cited

U.S. PATENT DOCUMENTS

| | | | | |
|---|---|---|---|---|
| 7,059,914 | B2 * | 6/2006 | Tsai | 439/660 |
| 7,066,769 | B2 * | 6/2006 | Zhu et al. | 439/660 |
| 7,090,540 | B2 * | 8/2006 | Masumoto et al. | 439/660 |
| 7,160,120 | B2 * | 1/2007 | Zhang et al. | 439/79 |
| 7,217,158 | B2 * | 5/2007 | Shimizu | 439/607.23 |

* cited by examiner

*Primary Examiner*—Hien Vu
(74) *Attorney, Agent, or Firm*—Rabin & Berdo, P.C.

(57) ABSTRACT

A mini plug connector has an insulative housing, a plurality of terminals and a metal shell. The insulative housing has a base, a tongue and a plurality of mounting holes. The tongue protrudes from the base and has a top, a space and at least one top elongated recess. The space and the at least one top elongated recess are defined in the top of the tongue. The terminals are mounted respectively through the mounting holes. The metal shell covers the insulative housing. The at least one top elongated recess prevents the insulative housing from being defective and deforming when the insulative housing is manufactured by an injection molding process.

6 Claims, 5 Drawing Sheets

MINI PLUG CONNECTOR

BACKGROUND OF THE INVENTION

1. Field of the Invention

The present invention relates to a connector, and more particularly to a mini plug connector that an insulative housing thereof would not deform after experiencing an injection molding process so that the mini plug connector has a desirable production rate.

2. Description of Related Art

Size reduction of connectors of electronic devices such as digital cameras and cellular phones is the inevitable trend nowadays when those electronic devices are designed more and more compact.

Conventional High Definition Multimedia Interface (HDMI) connectors have been further developed to Mini-HDMI connectors to lower the manufacturing cost, reduce the size and improve the production quality thereof.

However, when an insulative housing of the conventional Mini-HDMI connector is manufactured by an injection molding process, a mold receiving thermoplastic/thermosetting material is too small to be filled completely with the injected material and thus forms a defective insulative housing. Also, the insulative housing is probably inadvertently deformed when experiencing the injection molding process. Therefore, the conventional Mini-HDMI connector has a dissatisfactory production rate.

To overcome the shortcomings, the present invention provides a mini plug connector to mitigate or obviate the aforementioned problems.

SUMMARY OF THE INVENTION

The main objective of the invention is to provide a mini plug connector that an insulative housing thereof would not deform after experiencing an injection molding process so that the mini plug connector has a desirable production rate.

A mini plug connector in accordance with the present invention has an insulative housing, a plurality of terminals and a metal shell. The insulative housing has a base, a tongue and a plurality of mounting holes. The tongue protrudes from the base and has a top, a space and at least one top elongated recess. The space and the at least one top elongated recess are defined in the top of the tongue. The terminals are mounted respectively through the mounting holes. The metal shell covers the insulative housing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
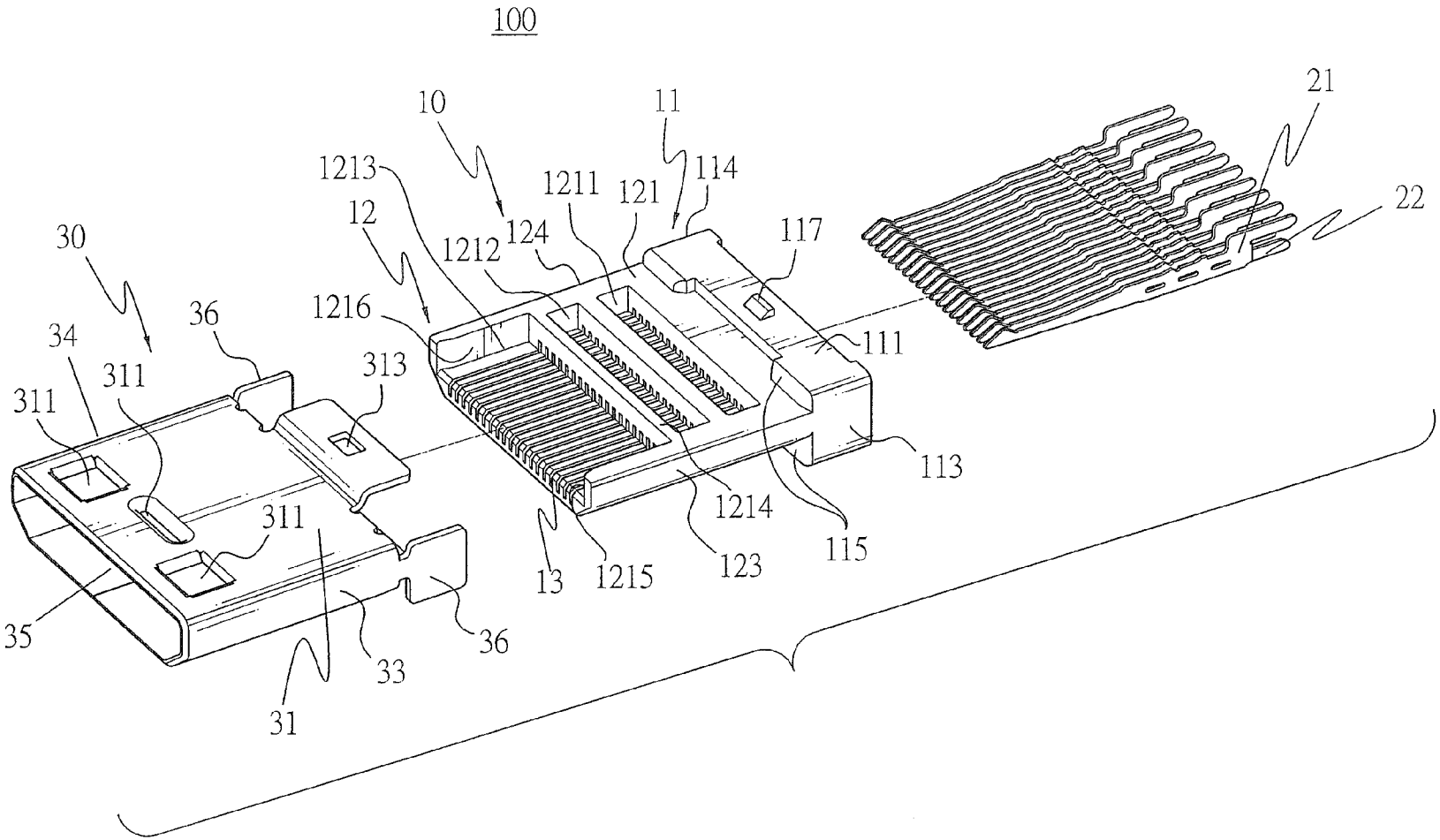
FIG. 1 is an exploded top perspective view of a mini plug connector in accordance with present invention.
Figure 2:
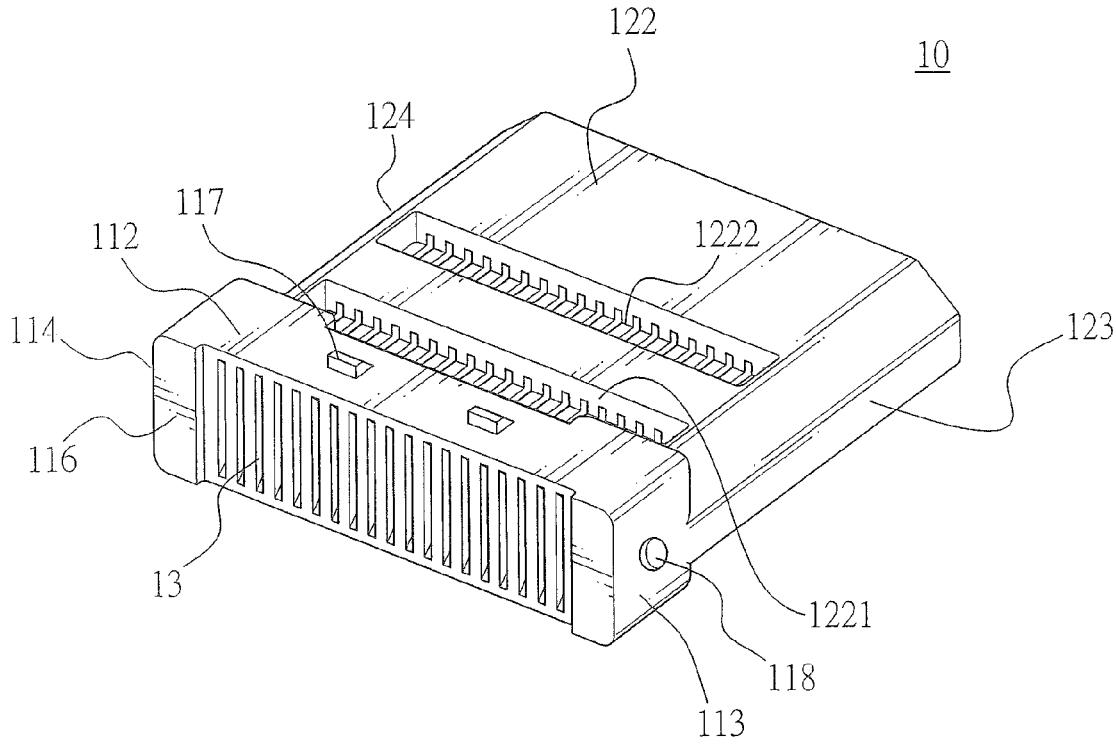
FIG. 2 is a bottom perspective view of the insulative housing of the mini plug connector in FIG. 1 further having two opposite two mounting protrusions.

With reference to FIGS. 1 and 2, a mini plug connector in accordance with the present invention, may be a Mini High Definition Multimedia Interface (Mini-HDMI) plug connector mating with a Mini-HDMI receptacle connector and comprises an insulative housing (10), a plurality of first terminals (21), a plurality of second terminals (22) and a metal shell (30).

The insulative housing (10) is made by an injection molding process and has a base (11), a tongue (12) and a plurality of mounting holes (13).

The base (11) is rectangular and has a top (111), a bottom (112), two opposite sides (113, 114), a front (115), a rear (116) and may further have a plurality of mounting hooks (117) and two mounting protrusions (118).

At least one of the mounting hook (117) is formed on the top (11) and remains of the mounting hooks (117) are formed on the bottom (112).

The mounting protrusions (118) are formed on and protrudes respectively from the sides (113, 114).

The tongue (12) is formed on and protrudes from the front (115) of the base (11) and has a top (121), a bottom (122), a front end, a rear end, two opposite sides (123, 124), a space (1213) and at least one top elongated recess (1211, 1212). The tongue (12) may further have at least one bottom elongated recess (1221, 1222) and a partition (1214).

The space (1213) is defined in the top (121) and the front end of the tongue (12) and has an inner bottom surface and two opposite inside surfaces (1215, 1216).

The at least one top elongated recess (1211, 1212) is defined transversely in the top (121) of the tongue (12) behind the space (1213). The at least one bottom elongated recess (1221, 1222) is defined transversely in the bottom (122) of the tongue (12) and may be aligned respectively with the at least one top elongated recess (1211, 1212) so that the elongated recesses (1211, 1212, 1221, 1222) are located on the at least one same vertical cross section of the tongue (12). Alternatively, the at least one bottom elongated recess (1221, 1222) may be misaligned and even staggered with the at least one top elongated recess (1211, 1212) so that the top and bottom elongated recesses (1211, 1212, 1221, 1222) are located on different vertical cross sections. The top and bottom elongated recesses (1211, 1212, 1221, 1222) are implemented for saving the material of insulative housing (10) and lowering the manufacturing cost. Furthermore, the top and bottom elongated recesses (1211, 1212, 1221, 1222) prevent the insulative housing (10) from being defective and fragmentary and deforming when the insulative housing (10) is formed by the injection molding process.

The partition (1214) is formed between the space (1213) and one top elongated recess (1212).

The mounting holes (13) are defined longitudinally through the insulative housing (11) from the rear (116) of the base (11) to the front end of the tongue (12) and communicate with the space (1213) and the at least one top elongated recess (1211, 1212). The mounting holes (13) may further communicate with the at least one bottom elongated recess (1221, 1222).

Figure 3:
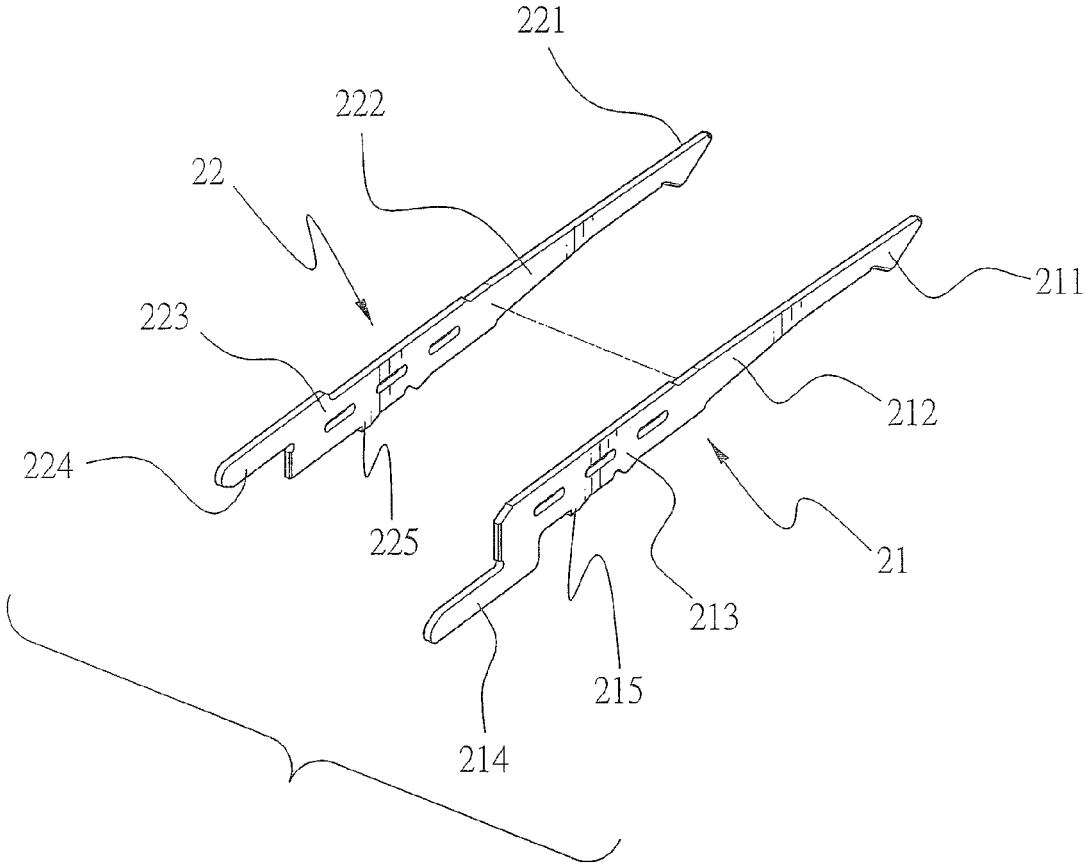
FIG. 3 is a bottom perspective view of the first and second terminals of the mini plug connector in FIG. 1.

With further reference to FIG. 3, the first terminals (21) and the second terminals (22) are mounted respectively through the mounting holes (13) and extend partially into the space (1213).

Each first terminal (21) has a mounting portion (213), an arm portion (212), a contacting portion (211) and an inserting portion (214) and may further have at least one interfering portion (215). The mounting portion (213) is mounted in the base (11). The arm portion (212) is resilient, is formed on and protrudes from the mounting portion (213), is mounted in the tongue (12) and is located in the space (1213). The contacting portion (211) is formed on and protrudes from the arm portion (212) and extends into the space (1213). The inserting portion (214) is formed on and protrudes from the mounting portion (213) opposite to the arm portion (212), may be inserted into a soldering hole of a printed circuit board and is located at a first level relative to the insulative housing (10).

Each second terminal (21) has a mounting portion (223), an arm portion (222), a contacting portion (221) and an inserting portion (224) and may further have at least one interfering portion (225). The mounting portion (223) is mounted in the base (11). The arm portion (222) is resilient, is formed on and protrudes from the mounting portion (223), is mounted in the tongue (12) and is located in the space (1213). The contacting portion (221) is formed on and protrudes from the arm portion (222) and extends into the space (1213). The inserting portion (224) is formed on and protrudes from the mounting portion (223) opposite to the arm portion (222) and is located in a second level relative to the insulative housing (10) being different from the first level.

Figure 4:
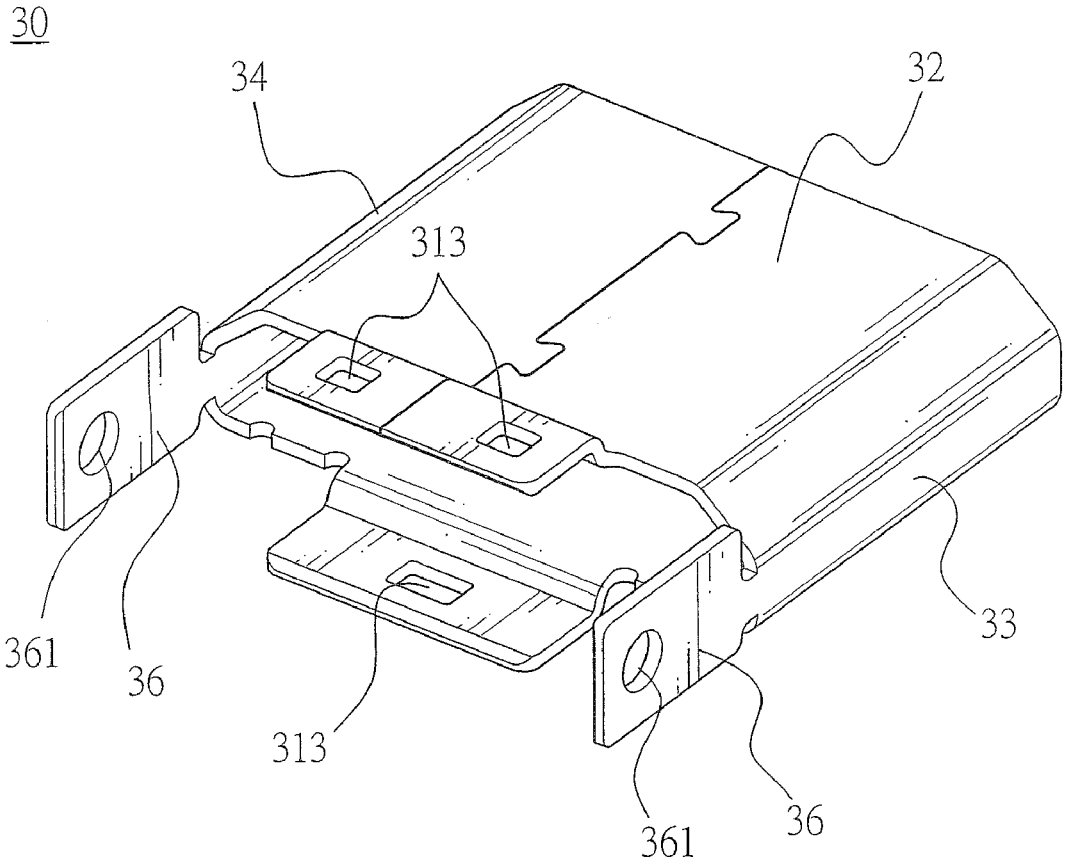
FIG. 4 is a bottom perspective view of the metal shell of the mini plug connector in FIG. 1 further having two opposite fastening holes.
Figure 5:
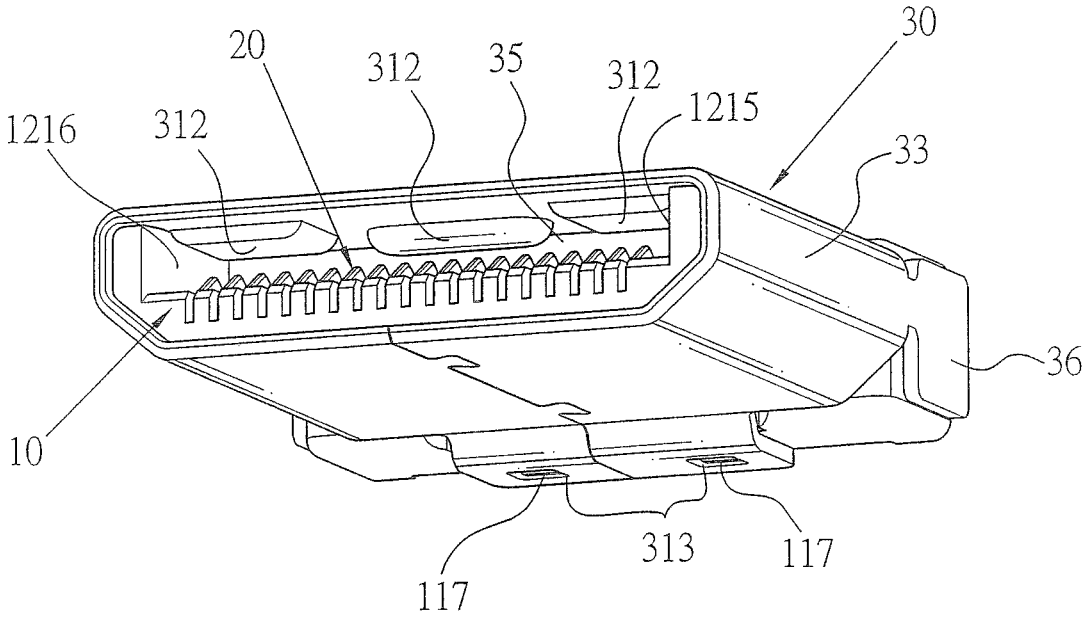
FIG. 5 is a front perspective of the mini plug connector in FIG. 1.

With further reference to FIGS. 4 and 5, the metal shell (30) is hollow and covers the insulative housing (10), the first terminals (21) and the second terminals (22). The metal shell (30) has a top plate (31), a bottom plate (32), two opposite side plates (33, 34), a cavity (35) and a plurality of pressing member (311) and may further have, a plurality of locking holes (313) and two fastening tabs (36).

The cavity (35) is defined in the metal shell (30) and is mounted around the tongue (12).

The pressing members (311) are formed on the top plate (31) by a stamping process and extends in the cavity (35) to press against and tightly hold a tongue of the Mini-HDMI receptacle connector mounted into the cavity (35). Furthermore, two of the pressing members (311) are respectively located adjacent to and abut respectively against the inside surfaces (1215, 1216) of the space (1213) of the tongue (12) to prevent the tongue (12) from inadvertently deforming. Each press member (311) has a flat bottom surface (312). The flat bottom surfaces (312) of the pressing member (312) are located in the same level relative to the insulative housing (10) to provide even pressing forces to the tongue of the Mini-HDMI receptacle connector.

At least one of the locking holes (313) is defined through the top plate (31) and remains of the locking holes (313) are defined through the bottom plate (32). The locking holes (313) are mounted respectively around and hooked by the mounting hooks (117) on the insulative housing (10). The fastening tabs (36) are formed on and protrude respectively backward from the side plates (33, 34). Each fastening tab (36) has a fastening hole (361) defined through the fastening tab (36) and mounted around one mounting protrusion (118) on the insulative housing (10).

The insulative housing (10) with the top and bottom elongated recesses (1211, 1212, 1221, 1222) would not be defective or deform when manufactured by the injection molding process. Therefore, the mini plug connector with the insulative housing has a high production rate and a lower manufacturing cost when compared to conventional connectors. Furthermore, the metal shell (30) having the pressing members (311) abutting respectively against the inside surfaces (1215, 1216) of the space (1213) of the tongue (12) effectively prevents the tongue (12) from inadvertently deforming.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mini plug connector comprising:

an insulative housing having a base having a top, a bottom, two opposite sides, a front and a rear;

a tongue formed on and protruding from the front of the base and having a top, a bottom, a front end, a rear end and two opposite sides and further having a space defined in the top and the front end of the tongue and having a partition, an inner bottom surface and two opposite inside surfaces; and at least one top elongated recess defined transversely in the top of the tongue behind the partition of the space; and a plurality of mounting holes defined longitudinally through the insulative housing from the rear of the base to the front end of the tongue and communicating with the space and the at least one top elongated recess;

a plurality of first terminals and a plurality of second terminals mounted respectively through the mounting holes and extending partially into the space; and a metal shell having a top plate, a bottom plate, two opposite side plates and covering the insulative housing and the first and second terminals and further having a cavity defined in the metal shell;

a plurality of pressing members formed on the top plate by a stamping process and extending in the cavity, and two of the pressing members respectively located adjacent to and abutting respectively against the inside surfaces of the two opposite sides of the space of the tongue;

wherein each pressing member of the metal shell has a flat bottom surface and the flat bottom surfaces of the pressing members are located in a same level relative to the insulative housing; and wherein the base further has a plurality of mounting hooks, at least one of the mounting hooks is formed on the top and remains of the mounting hooks are formed on the bottom of the base; and the metal shell further has a plurality of locking holes, at least one of the locking holes is defined through the top plate, remains of the locking holes are defined through the bottom plate, and the locking holes axe mounted respectively around and hooked by the mounting hooks on the insulative housing.

2. The mini plug connector as claimed in claim 1, wherein the tongue of the insulative housing further has at least one bottom elongated recess defined transversely in the bottom of the tongue.

3. The mini plug connector as claimed in claim 2, wherein each of the first and second terminals has a mounting portion mounted in the base;

an arm portion being resilient, formed on and protruding from the mounting portion, mounted in the tongue and located in the space;

a contacting portion formed on and protruding from the arm portion and extending into the space; and an inserting portion formed on and protruding from the mounting portion opposite to the arm portion; and the insert portion of each first terminal is located in a first level relative the insulative housing and the insert portion of each second terminal is located in a second level relative to the insulative housing being different from the first level.

4. The mini plug connector as claimed in claim 1, wherein:

the base further has two mounting protrusions formed on and protruding respectively from the sides of the base; and the metal shell further has two fastening tabs formed on and protruding respectively backward from the side plates and each fastening tab has a fastening hole defined through the fastening tab and mounted around one mounting protrusion on the insulative housing.

5. The mini plug connector as claimed in claim 4, wherein the at least one bottom elongated recess is aligned respectively with the at least one top elongated recess.

6. The mini plug connector as claimed in claim 4, wherein the at least one bottom elongated recess is misaligned with the at least one top elongated recess.

* * * * *